US007959741B2

(12) United States Patent
Green

(10) Patent No.: US 7,959,741 B2
(45) Date of Patent: Jun. 14, 2011

(54) FUEL TANK CLEANING METHOD

(76) Inventor: Ted Joseph Green, Somerset, OH (US)

( * ) Notice: Subject to any disclaimer, the term of this patent is extended or adjusted under 35 U.S.C. 154(b) by 295 days.

(21) Appl. No.: 12/338,390

(22) Filed: Dec. 18, 2008

(65) Prior Publication Data

US 2010/0154828 A1 Jun. 24, 2010

(51) Int. Cl.
*B08B 3/02* (2006.01)

(52) U.S. Cl. ... 134/24; 134/22.1; 134/22.18; 137/15.04; 137/590

(58) Field of Classification Search ..... 134/22.1, 134/22.18, 24, 42; 137/15.4, 590
See application file for complete search history.

(56) References Cited

U.S. PATENT DOCUMENTS

| | | | | |
|---|---|---|---|---|
| 2,045,752 | A | 6/1936 | Butterworth | |
| 2,289,109 | A | 7/1942 | Edwards et al. | |
| 2,933,093 | A | 4/1960 | Handyside | |
| 3,460,988 | A | 8/1969 | Kennedy, Jr. et al. | |
| 3,563,464 | A | 2/1971 | Doornbos et al. | |
| 3,600,225 | A * | 8/1971 | Parmelee | 134/24 |
| 3,833,010 | A * | 9/1974 | McDermott et al. | 134/24 |
| 4,064,293 | A | 12/1977 | Nicklas | |
| 4,146,406 | A * | 3/1979 | Sampsell | 134/167 R |
| 4,244,523 | A | 1/1981 | Looper | |
| 4,341,232 | A | 7/1982 | Maton | |
| 4,667,351 | A | 5/1987 | Williams | |
| 4,770,711 | A | 9/1988 | Deal, III et al. | |
| 4,828,625 | A | 5/1989 | Moran | |
| 4,859,249 | A | 8/1989 | Valentini | |
| 5,065,781 | A * | 11/1991 | Cox | 137/15.04 |
| 5,087,294 | A | 2/1992 | Rechtzigel | |
| 5,095,929 | A | 3/1992 | Harvey | |
| 5,195,548 | A | 3/1993 | Roger | |
| 5,279,675 | A | 1/1994 | Verbeek | |
| 5,301,702 | A | 4/1994 | McKinney | |
| 5,518,553 | A | 5/1996 | Moulder | |
| 5,720,310 | A | 2/1998 | Moulder | |
| 6,021,793 | A | 2/2000 | Moulder | |
| 6,213,135 | B1 | 4/2001 | Moulder | |
| 6,371,137 | B1 | 4/2002 | Heath | |
| 6,460,553 | B1 | 10/2002 | Owens et al. | |
| 7,082,952 | B1 | 8/2006 | McCasker et al. | |
| 7,320,329 | B2 | 1/2008 | Luke et al. | |
| 2004/0134518 | A1 | 7/2004 | Kraus et al. | |
| 2004/0238009 | A1 | 12/2004 | Falster-Hansen et al. | |
| 2005/0183745 | A1 | 8/2005 | Glicksman | |
| 2008/0047587 | A1 | 2/2008 | Ball | |

* cited by examiner

*Primary Examiner* — Michael Barr
*Assistant Examiner* — Saeed T Chaudhry
(74) *Attorney, Agent, or Firm* — Ashkan A. Aminian; Kremblas & Foster

(57) ABSTRACT

A method for cleaning the interior surfaces of a fuel storage tank. The first step of the method is to extract a material sample from the bottom of the fuel tank to determine how thoroughly the tank must be cleaned. The clean fuel is then removed from the tank and is stored in a holding tank. Loose and liquid contaminants are then vacuumed out of the tank. Next, a self-propelled spray nozzle, a sprayer tube, and a rotating spray nozzle, each of which is connected to a pressurized water supply line, are successively lowered into the fuel tank and are used to scour the various interior surfaces of the tank with pressurized water while wash water and loosened contaminants are simultaneously vacuumed out of the tank. The interior of the tank is then dried, and the clean fuel stored in the holding tank is pumped back into the fuel tank.

8 Claims, 7 Drawing Sheets

FIG. 9
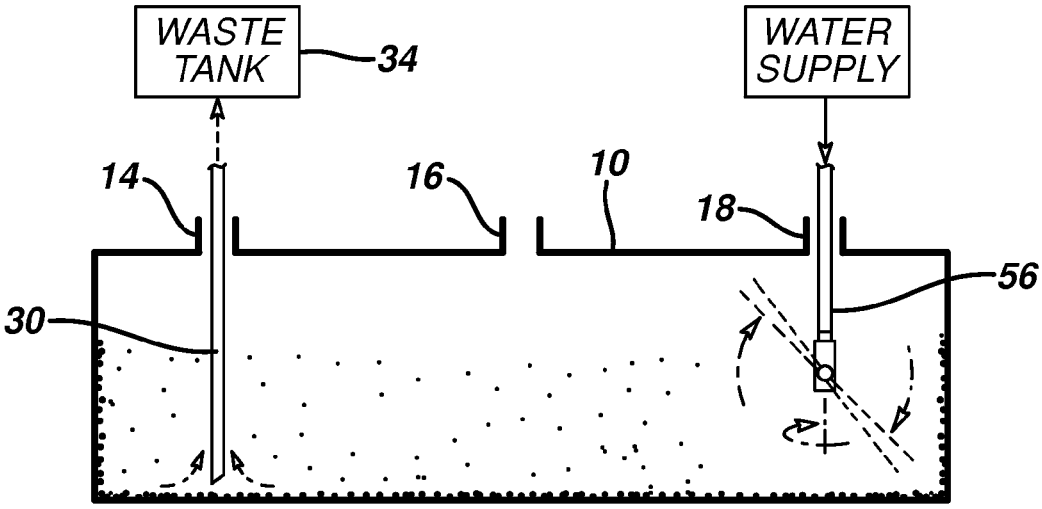
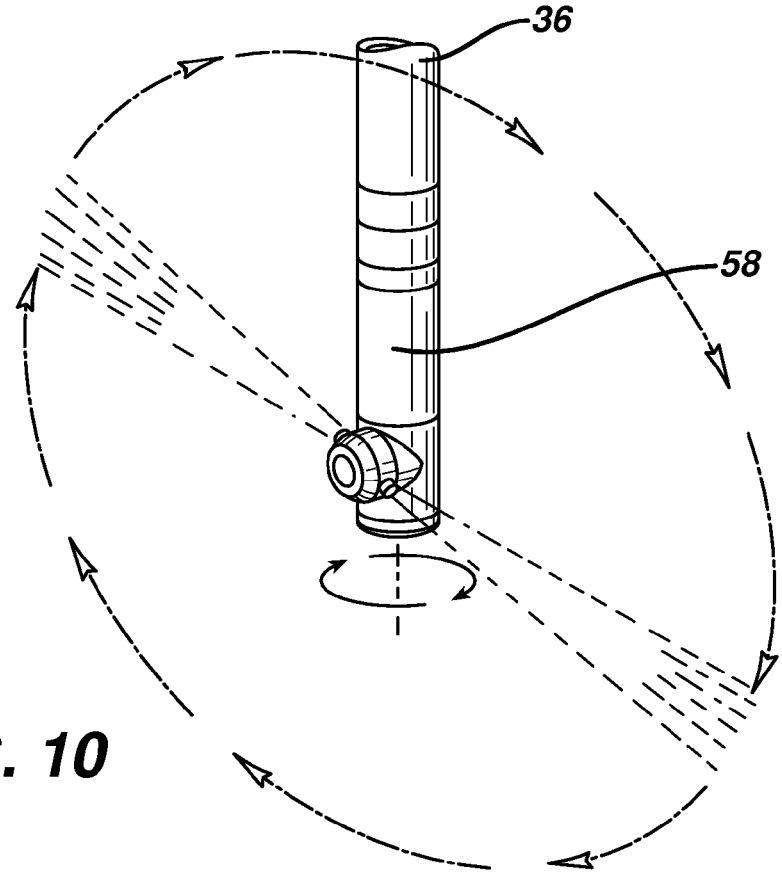
FIG. 10

FUEL TANK CLEANING METHOD

BACKGROUND OF THE INVENTION

1. Field of the Invention

This invention relates generally to the field of fuel storage tanks and more particularly to an improved method for cleaning the interior of a fuel storage tank.

2. Description of the Related Art

Fuel storage tanks (herein also referred to as "fuel tanks" or "storage tanks") are large cylindrical vessels that are commonly maintained at automobile filling stations for storing quantities of fuel, such as gasoline, diesel, and kerosene. Fuel tanks are typically installed several feet underground in a generally horizontal orientation, although above-ground fuel storage tanks are not uncommon.

Over time, water and other liquid and solid fuel contaminants settle and accumulate on the interior surfaces of a fuel storage tank. Fuel tanks must therefore be cleaned on a periodic basis to preserve the quality of the fuel that is stored inside of them. Traditionally, fuel tank cleaning has been accomplished by a process known as kidney loop filtration. This process generally involves pumping stored fuel out of a fuel tank, processing the fuel through a series of filters to remove water and other contaminants from the fuel, and then pumping the filtered fuel back into the fuel tank. This process is repeated in a closed-loop manner with the fuel constantly being cycled from the fuel tank, through filters, and back into the fuel tank until it is determined that the fuel is sufficiently free of contaminants.

A problem that is commonly associated with kidney loop filtration is that the wash force generated by the fuel that is circulated through a fuel storage tank during the cleaning process is often insufficient to loosen heavier contaminants that tend to adhere to the bottom, side, and, to a lesser extent, upper surfaces of the interior of the fuel tank. A layer of heavy contaminants therefore continues to accumulate within the fuel tank unabated through successive cleanings. Stored fuel is thus constantly exposed to the growing layer of contaminants, which results in higher and faster-accumulating levels of contamination in the stored fuel than would normally be present in fuel having no such continuous contaminant exposure.

It is therefore desirable to have an efficient method for effectively cleaning contaminants from the interior of a fuel storage tank, including those heavy contaminants that adhere to a fuel tank's various interior surfaces and tend to resist traditional cleaning methods such as kidney loop filtration.

BRIEF SUMMARY OF THE INVENTION

In accordance with the present invention there is provided an improved method for cleaning fuel storage tanks, such as those commonly used at filling stations. Preferably, the first step of the method includes extracting a material sample from the bottom of the fuel tank using a conventional bacon bomb sampler. The sample is visually inspected to approximate the amount of contaminant present in the fuel tank and to determine how thoroughly the fuel tank should be cleaned.

Next, the clean fuel contained in the fuel tank (which floats atop a layer of water and other contaminants) is pumped out of the fuel tank and into a holding tank. As the fuel is transferred from the fuel tank to the holding tank, it is preferably processed through a series of conventional fuel filters to remove impurities. After all of the fuel has been transferred, water and other loose or liquid contaminants are vacuumed out of the fuel tank and into a waste tank using an elongated steel vacuum tube (herein referred to as the "stinger") that is connected to a vacuum hose. The vacuum hose preferably has an integrated sight glass for allowing an operator to observe material flowing through the hose.

Next, a first spraying rig is preferably lowered through an opening nearest one longitudinal end of the fuel tank. The spraying rig includes the stinger (described above) and a high pressure water supply hose terminating in a conventional self-propelled spray nozzle. The water hose and self-propelled nozzle are loosely held adjacent the tip of the stinger by a bracket that is pivotably mounted to the stinger.

The tip of the stinger and the self-propelled nozzle are brought to rest on the floor of the tank with the nozzle directed toward the far end of the tank. Pressurized water is then fed to the nozzle through the water hose. The pressurized water exits the nozzle through several radially and longitudinally directed apertures at a rearward angle, thereby propelling the nozzle and the attached hose forward while simultaneously loosening contaminants on the interior of the tank.

Once the nozzle reaches the far end of the fuel tank, an operator pulls upwardly on the water hose, thereby drawing the hose relative to the bracket and pulling the self-propelled nozzle back toward the stinger. As the nozzle is pulled rearwardly, the pressurized water emitted from the nozzle further loosens contaminants on the interior surfaces of the tank and pushes the contaminants and wash water toward the stinger where they are vacuumed into the waste tank. Once an operator observes through the sight glass in the vacuum hose that the water flowing through the hose is substantially free of large particles of contaminant, the water is shut off and the spraying rig is withdrawn from the fuel tank.

Next, a lateral sprayer including an elongated sprayer tube connected to a pressurized water supply hose is lowered through an opening nearest one longitudinal end of the fuel tank and is brought to rest on the floor of the tank. The stinger is lowered through an opening nearest the opposite longitudinal end of the tank and is brought to rest on the floor of the tank. The sprayer tube has an outlet aperture adjacent its tip that is configured to spray a pressurized stream of water at a generally transverse angle relative to the tube for scouring the bottom and sides of the tank.

Pressurized water is then fed to the sprayer tube through the water supply line. The stream of water emitted from the outlet aperture loosens contaminants on the bottom and sides of the tank and is simultaneously used to direct wash water and loosened contaminants toward the stinger, where they are vacuumed out of the fuel tank. Once an operator observes through the sight glass in the vacuum hose that the water flowing through the hose is substantially free of large particles of contaminant, the water is shut off and the lateral sprayer and stinger are withdrawn from the fuel tank. The sprayer and the stinger can be subsequently lowered through various different openings in the fuel tank to more effectively clean different portions of the tank.

Next, a rotational sprayer is lowered through an opening nearest a first longitudinal end of the fuel tank and the stinger is lowered into an opening nearest the opposite longitudinal end of the tank. The rotational sprayer comprises a high pressure water supply line terminating in a conventional rotating spray nozzle that spins in a 360 degree pattern while spraying pressurized water out of two radially-opposed apertures. The rotating spray nozzle is suspended in the fuel tank by the water supply line intermediate the floor and the ceiling of the tank.

Pressurized water is then fed to the rotating spray nozzle through the water supply line, and the resulting spray pattern loosens and washes contaminants from substantially all of the interior surfaces of the fuel tank. Again, the stinger collects the wash water and loosened contaminants from the bottom of the fuel tank and transfers them to the waste tank. When the wash water observed through the vacuum hose sight glass appears to be clean, the water is shut off and the rotational sprayer and stinger are removed from the tank.

Once the tank is determined to be clean, the tank is preferably dried using a smaller stinger having a greater vacuum force. A small quantity of clean fuel is then pumped from the holding tank into the fuel tank to flush any residual water from one end of the tank toward the stinger, where it is vacuumed into the waste tank. The remaining clean fuel in the holding tank is then pumped back into the tank. Another bacon bomb sample is taken to ensure that the tank is clean.

BRIEF DESCRIPTION OF THE SEVERAL VIEWS OF THE DRAWINGS

FIG. 9 is a side view in section illustrating the preferred embodiment of the sixth step of the present invention with the rotational sprayer being used to clean the fuel storage tank.

FIG. 10 is a detail perspective illustrating the rotational sprayer used in the preferred embodiment of the sixth step of the present invention.

Figure 1:
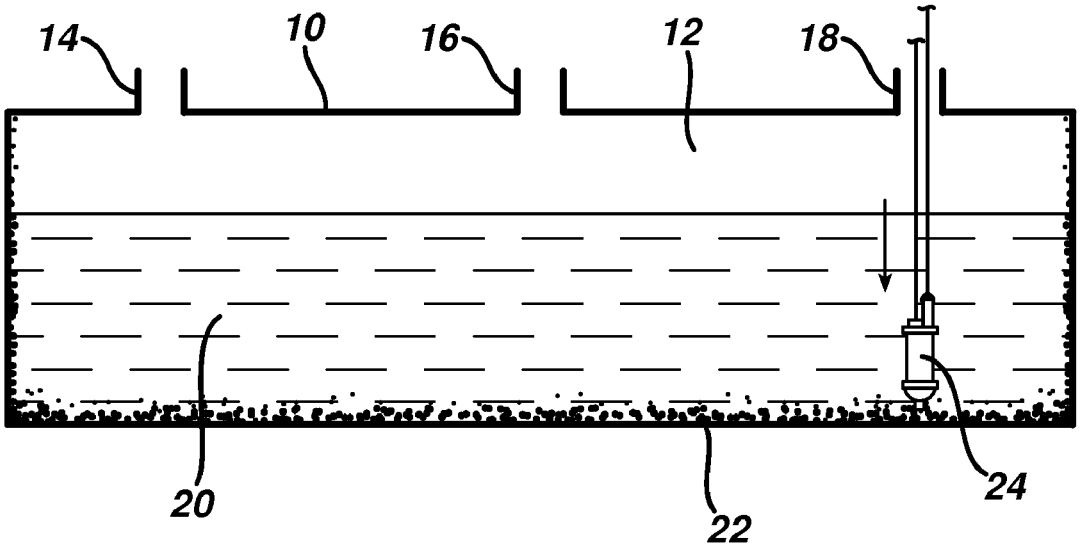
FIG. 1 is a side view in section illustrating the preferred embodiment of the first step of the present invention with the bacon bomb sampler being lowered into the fuel storage tank.
Figure 2:
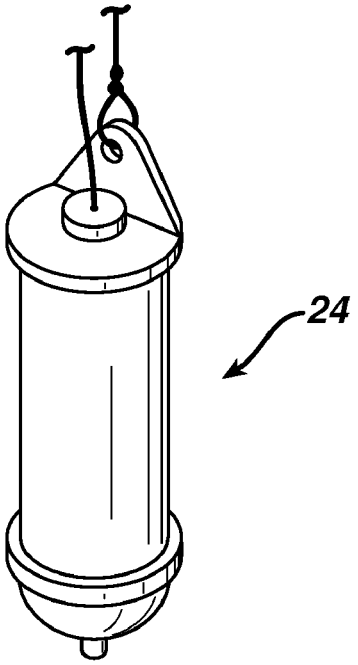
FIG. 2 is a perspective view illustrating the bacon bomb sampler.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

Referring to FIGS. 1-13, an improved method for cleaning a fuel storage tank, such as the fuel tank 10, is illustrated as a progressive series of individual steps. It should be noted, however, that the particular order of steps shown in the figures and described herein is provided as an example only. It is contemplated that the various steps of the cleaning method can be rearranged or omitted as necessary (as will be described in greater detail below) to accommodate specific cleaning applications without departing from the spirit of the invention. Furthermore, while the exemplary series of steps shown and described herein is employed to clean an underground fuel storage tank, it is contemplated that the method can alternatively be used for cleaning aboveground fuel storage tanks as well as various other types of storage tanks, such as those used for storing chemicals or food items.

For the sake of convenience and clarity, terms such as "left," "right," "top," "bottom," "up," "down," "horizontal," "vertical," "lateral," and "longitudinal" will be used herein to describe the relative placement and orientation of various components of the invention, all with respect to the geometry and orientation of the fuel storage tank 10 as it appears in FIG. 1. Said terminology will include the words specifically mentioned, derivatives thereof, and words of similar import. Furthermore, while the fuel storage tank 10 shown in the figures is cylindrical in shape with a single curved sidewall 12, the terms "floor" and "ceiling" will be used herein to describe the lower and upper portions of the interior surface of the sidewall 12, respectively.

Referring now to FIG. 1, the underground fuel storage tank 10 has three longitudinally-spaced openings 14, 16, and 18 formed in its top surface. During normal use of the fuel tank 10 (i.e., when the fuel tank 10 is being used to store and supply fuel) the openings 14-18 accommodate a pump (for extracting fuel from the tank), a probe (for detecting corrosion or leakage in the tank), and a drop tube (for adding fuel to the tank). The pump, probe, and drop tube are removed from the tank before the cleaning process is initiated and are therefore not shown in the figures.

Still referring to FIG. 1, a first optional step in the cleaning process is to gauge the amount and density of contaminants present in the fuel storage tank 10. Although not required, this step is useful for determining how thoroughly the fuel tank 10 should be cleaned and for facilitating a before-and-after comparison of the cleanliness of the fuel tank 10 once cleaning has been completed.

Water and other contaminants are generally denser than fuel and therefore tend to settle on the bottom of the fuel storage tank 10. Water and petroleum fuel are generally immiscible, and thus form separate and distinct layers 20 and 22 within the tank, with the less dense fuel layer 20 floating atop the layer of water and other contaminants 22 (herein referred to as the "contaminant layer"). In order to collect a sample from the contaminant layer 22, a conventional bacon bomb sampler 24 (shown in greater detail in FIG. 2) or other device that is capable of reaching through the fuel layer 20 without collecting clean fuel is lowered through one of the openings 14-18 in the tank 10 to the bottom of the tank 10 to retrieve a small material sample. The sample is then deposited in a jar or other vessel and is visually inspected. The bacon bomb sampler 24 can subsequently be lowered through other openings in the fuel tank 10 for acquiring additional material samples from other locations along the bottom of the fuel tank 10 if desired. Although a conventional bacon bomb sampler is preferred for collecting contaminant samples from the bottom of the fuel storage tank 10, it is contemplated that any other suitable means can be employed for testing or gauging contaminant levels in the fuel tank 10, such as by various other conventional samplers used for collecting liquid samples at the bottom or at intermediate depths of a vessel that will be familiar to those skilled in the art.

Figure 3:
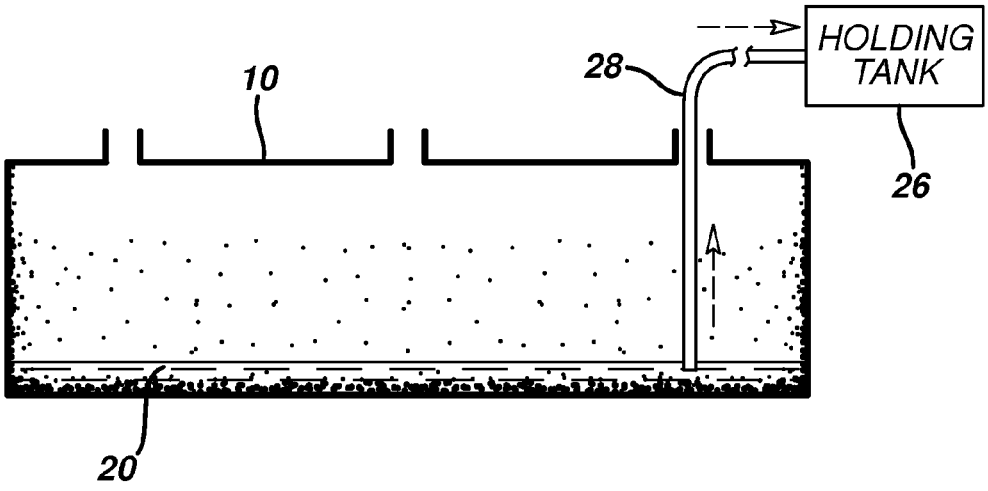
FIG. 3 is a side view in section illustrating the preferred embodiment of the second step of the present invention with clean fuel being removed from the fuel storage tank.

Referring to FIG. 3, the stored fuel in the fuel layer 20 is then pumped out of the fuel storage tank 10 and is subsequently fed through a series of conventional fuel filters (not shown) and is deposited in a holding tank 26, such as the tank of a petroleum tank truck. Although it is preferred that the fuel be filtered before being deposited in the holding tank 26, it is contemplated that the fuel can alternatively or additionally be filtered when it is pumped from the holding tank 26 back into the fuel tank 10 (as described in greater detail below). It is further contemplated that the fuel can be transferred between the tanks 10 and 26 without being filtered.

As the fuel is pumped out of the fuel tank 10, it is conveyed to the holding tank through a pump hose 28 having an integrated sight glass (not shown) for allowing an operator to view material passing through the hose 28 as the material exits the fuel tank 10. The operator monitors the sight glass while pumping material out of the fuel tank 10 until he observes contaminant, as opposed or in addition to fuel, flowing through the pump hose 28, at which point substantially all of the clean fuel has been removed from the fuel tank 10 and pumping is ceased. Although a sight glass is preferred for observing material flowing through the pump hose 28, it is contemplated that any other suitable means, such as video monitoring, can be employed for observing the material flow.

If a pump hose with a sight glass is not available, or if an operator wishes to separately verify the depth of the fuel layer 20 in the fuel tank 10 before extracting the fuel, it is contemplated that any conventional method can alternatively or additionally be employed for determining the depth of the fuel layer 20. For example, a stick or a pole coated with a water-indicating substance, such as Sar-Gel paste available from Sartomer, can be lowered to the bottom of the fuel tank 10 for recording the height of the contaminant layer 22, and thus the depth of the bottom of the fuel layer 20. After examining the line of demarcation on the stick, an operator will know to what depth he can pump fuel from within the tank 10 without extracting material from the contaminant layer 22.

Figure 4:
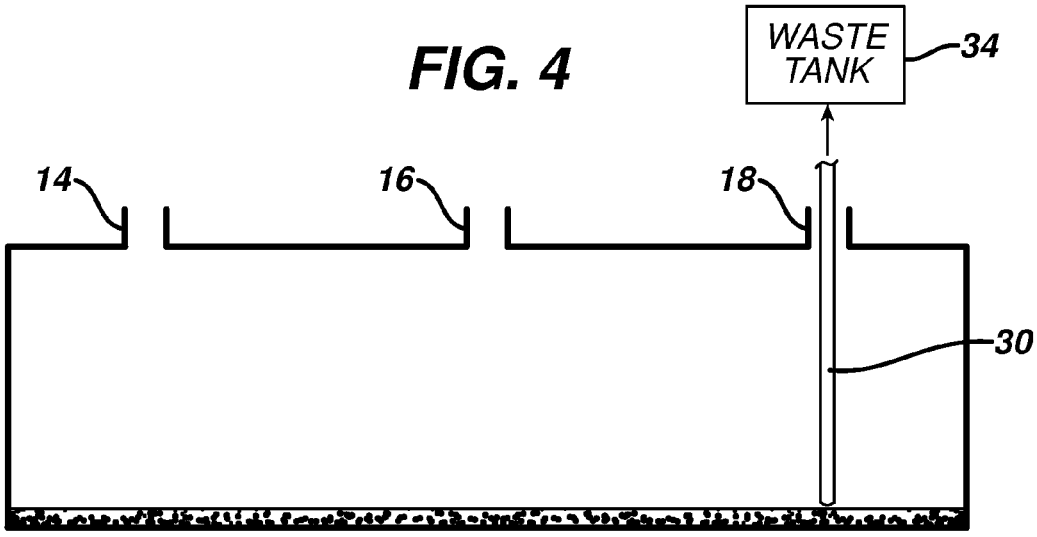
FIG. 4 is a side view in section illustrating the preferred embodiment of the third step of the present invention with loose contaminants being vacuumed out of the fuel storage tank.

Next, referring to FIG. 4, an elongated steel vacuum tube 30 (herein referred to as the "stinger") is lowered through one of the openings 14-18 in the fuel tank 10. The stinger 30 has an open bottom end and is connected at its top end to a vacuum hose (not within view) leading to a tank 34 (herein referred to as the "waste tank") of a conventional vacuum truck. An operator uses the stinger 30 to vacuum remaining loose and liquid contaminants out of the fuel tank 10 and into the waste tank 34. Preferably, the stinger 30 is successively lowered through each of the longitudinally-spaced openings 14-18 in the fuel tank 10 so that the various lower interior surfaces of the fuel tank 10 can be reached.

Similar to the pump hose 28 described above, the vacuum hose has an integrated sight glass for allowing an operator to view material flowing through the hose. By observing vacuumed contaminant as it flows through the hose, the operator can gauge the dirtiness of the fuel tank's interior and make a judgment regarding how thoroughly the fuel tank 10 must be cleaned. For example, if the operator observes that the material flowing through the vacuum hose consists primarily of light colored liquid contaminant and small particles of solid contaminant, the operator can presume that the fuel tank 10 is relatively clean and requires relatively light cleaning. Conversely, if the operator observes large particles of solid contaminant and dark colored, highly viscous liquid contaminant flowing through the vacuum hose, the operator can presume that the fuel tank 10 requires more thorough cleaning.

Figure 5:
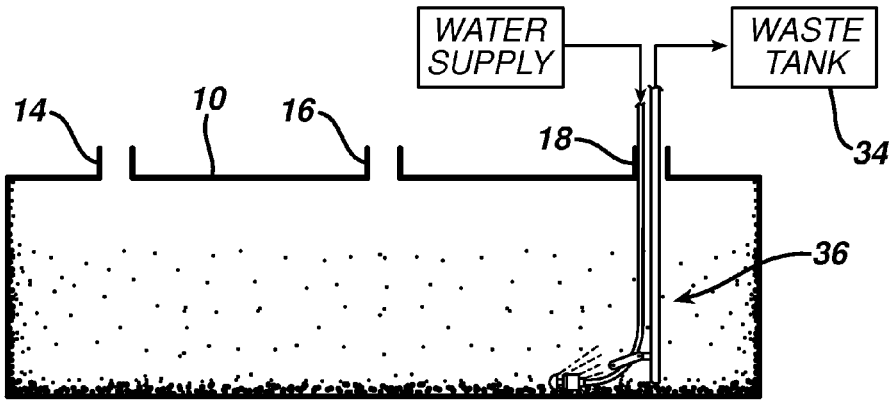
FIG. 5 is a side view in section illustrating the preferred embodiment of the fourth step of the present invention with the self-propelled nozzle being used to clean the fuel storage tank.
Figure 6:
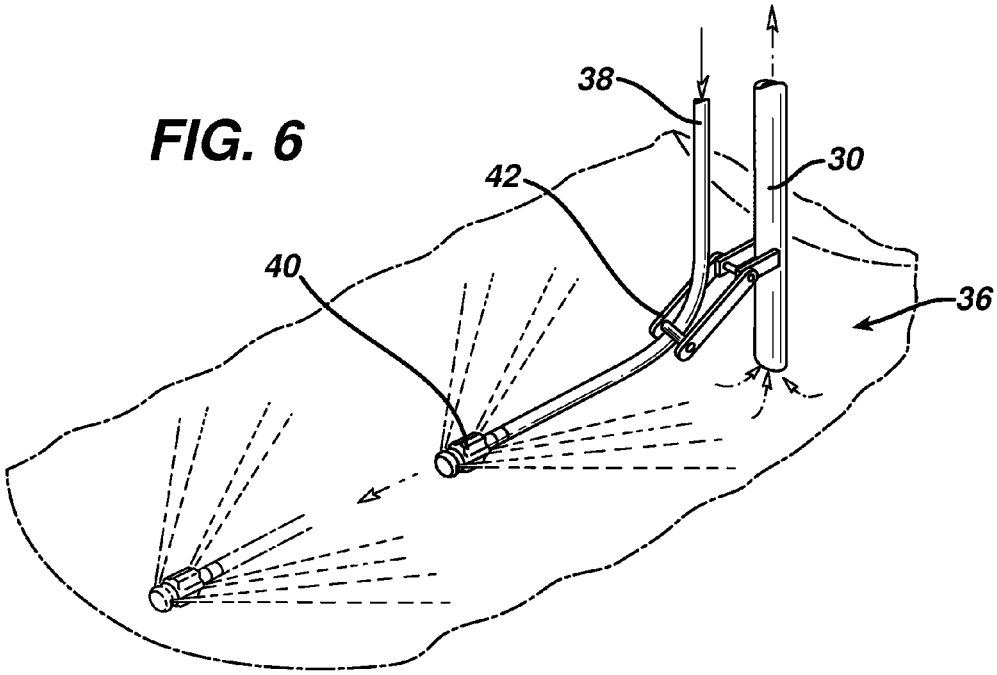
FIG. 6 is a partial perspective view in detail illustrating the preferred embodiment of the fourth step of the present invention.

Next, if it has been determined that the fuel storage tank 10 is heavily contaminated and requires thorough cleaning, a first spraying rig 36 is lowered through one of the openings 14-18 nearest a longitudinal end of the fuel tank 10, as shown in FIG. 5. Referring now to FIG. 6, the spraying rig 36 includes the stinger 30 (described above), and a water supply line 38 terminating in a conventional self-propelled nozzle 40. A nozzle that has been found to work particularly well is the Primus nozzle available from Southeast Environmental Services (SES), although it is contemplated that a variety of other similar commercially available nozzles can alternatively be used.

Still referring to FIG. 6, the water supply line 38 is loosely held adjacent the tip of the stinger 30 by a bracket 42 that is pivotably mounted to the stinger 30. The tip of the stinger 30 and the self-propelled nozzle 40 are brought to rest on the floor of the fuel tank 10 with the nozzle 40 directed toward the far longitudinal end of the tank 10. Pressurized water is then fed to the self-propelled nozzle through the water supply line 38. The pressurized water exits the nozzle 40 through several radially and longitudinally directed apertures at a rearward angle, thereby propelling the nozzle 40 and the attached water supply line 38 forward, along the floor of the tank 10, while simultaneously scouring the interior surfaces of the tank 10 and loosening contaminants. As the nozzle advances along the floor, the force of the pressurized water exiting the rear of the nozzle 40 (preferably in a range of about 500 psi to about 2000 psi at a rate of about 20-25 gallons per minute) directs the loosened contaminants and the wash water back toward the tip of the stinger 30, where they are vacuumed out of the fuel tank 10 and into the waste tank 34.

Preferably, the water supply line 38 is provided with only enough slack to allow the self-propelled nozzle to reach the far longitudinal end of the fuel tank 10. Once the nozzle reaches the far end of the fuel tank 10, the operator pulls upwardly on the water supply 38 line with enough force to overcome the forward propulsion of the self-propelled nozzle 40, thereby drawing the supply line 38 relative to the bracket 42 and pulling the nozzle 40 rearwardly, along the floor of the fuel tank 10 and back toward the stinger 30. As the nozzle 40 moves rearwardly, the pressurized water emitted from the nozzle 40 loosens additional contaminants on the interior surfaces of the tank 10 and pushes the contaminants and wash water toward the stinger 30 where they are continually vacuumed out of the fuel tank 10.

After the self-propelled nozzle 40 has been pulled substantially back to the stinger 30, the operator can release the water supply line 38 and allow the nozzle 40 to again advance forward, toward the far end of the tank 10 in order perform additional scouring. This process is repeated until most of the large particles of contaminant have been cleaned from the tank 10, as determined by the operator looking through the sight glass in the vacuum hose 28. Once the operator determines that the fuel tank 10 is sufficiently free of large particles of contaminant, the spraying rig 36 is withdrawn from the opening 18. Although it is typically only necessary for the spraying rig 36 to be utilized at one longitudinal end of a fuel tank 10, it is contemplated that the above-described process can be repeated with the spraying rig 36 lowered through the opening 14 adjacent the opposite longitudinal end of the fuel tank 10 with the stinger 30 moved accordingly.

Figure 7:
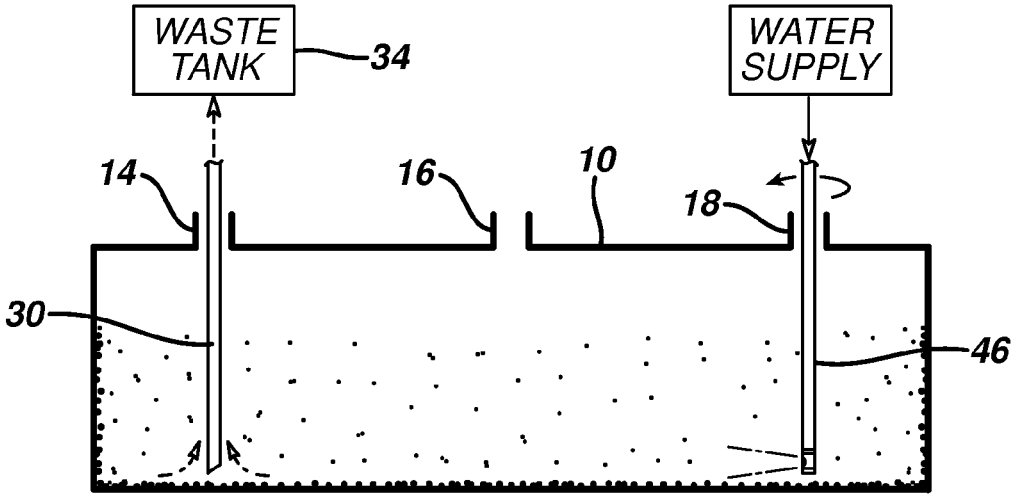
FIG. 7 is a side view in section illustrating the preferred embodiment of the fifth step of the present invention with the lateral sprayer being used to clean the fuel storage tank.
Figure 8:
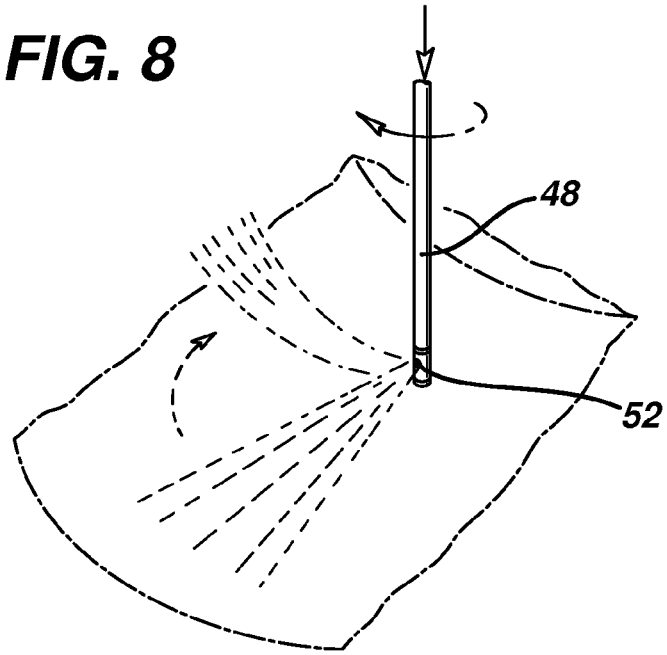
FIG. 8 is a partial perspective view in detail illustrating the preferred embodiment of the fifth step of the present invention.

Referring now to FIGS. 7 and 8, a next optional step of the cleaning method involving a lateral sprayer 46 is illustrated. As with the spraying rig 36 described above, the lateral sprayer 46 is typically employed when it is determined that a fuel storage tank is heavily contaminated. The lateral sprayer 46, which includes an elongated steel sprayer tube 48 connected to the water supply line 38 (not within view), is lowered through an opening 18 nearest one end of the fuel tank 10 and is brought to rest on the floor of the fuel tank 10. The sprayer tube 48 has a closed bottom end and a small outlet aperture 52 formed in its sidewall. The stinger 30 (described above) is lowered through the opening 14 nearest the opposite end of the fuel tank 10 and is brought to rest on the floor of the fuel tank 10.

Once the lateral sprayer 46 and the stinger 30 are in position, pressurized water is supplied to the sprayer tube 48 through the water supply line 38. The water exits the outlet aperture 52 in a concentrated, high pressure stream at a generally transverse angle relative to the sprayer tube 48 and scours the floor and walls of the fuel tank 10. The force of the pressurized water (preferably about 1500 psi at a rate of about 20-25 gallons per minute) loosens heavy contaminants that tend to adhere to the lower surfaces of the interior of the fuel tank 10. Although the particular lateral sprayer 46 is the preferred apparatus for achieving this step of the cleaning method, it is contemplated that any spraying means that is capable of being lowered into the fuel tank 10 and spraying one or more streams of pressurized water laterally along the tank's floor can be used.

While spraying, the operator preferably shifts and rotates the sprayer tube 48 in order to direct the stream of water toward as large an area of the tank's floor as possible, as shown in FIG. 8. Occasionally, the operator directs the stream toward the far end of the fuel tank 10, thereby forcing the wash water and loosened contaminants toward the stinger 30 where they are vacuumed out of the fuel tank 10 and into the waste tank 34.

When the operator observes through the sight glass in the vacuum hose that the wash water is sufficiently free of contaminants, spraying is ceased and the lateral sprayer 46 is withdrawn from the fuel tank 10. The above-described process is preferably repeated with the lateral sprayer 46 being lowered through the other openings in fuel tank 10 and the stinger 30 being moved as necessary.

Next, referring to FIGS. 9 and 10, a rotational sprayer 56 which includes the water supply line 36 terminating in a conventional rotating spray nozzle 58 is lowered through an opening 18 nearest one longitudinal end of the fuel storage tank 10. A spray nozzle that has been found to work particularly well is the Gamajet IX available from Gamajet, although it is contemplated that various other commercially available rotating spray nozzles can be used. Unlike the lateral sprayer 46 and the self-propelled nozzle 40 described above, the rotational sprayer 56 is not brought to rest on the floor of the fuel tank 10, but is instead suspended by the water supply line 36 in a position substantially intermediate the floor and the ceiling of the fuel tank 10 (as shown in FIG. 9). The stinger 30 (described above) is lowered through the opening 14 nearest the opposite end of the fuel tank 10 and is brought to rest on the floor of the fuel tank 10.

Once the rotational sprayer 56 and the stinger 30 are in position, pressurized water is supplied to the rotating spray nozzle 58 through the water supply line 36. The spray nozzle 58 has two radially-opposed apertures that simultaneously rotate about a first vertical axis and a second horizontal axis and emit concentrated streams of pressurized water that scour substantially all of the interior surfaces of the fuel tank 10. The force of the pressurized water (preferably in a range of about 500 psi to about 800 psi at a rate of about 20-25 gallons per minute) thus loosens and washes contaminants from the interior surfaces of the fuel tank 10.

As the wash water and loosened contaminants collect at the bottom of the fuel tank 10 and flow to the stinger 30, they are vacuumed out of the fuel tank 10 and into the waste tank 34. Spraying is ceased when the wash water observed through the vacuum hose sight glass appears to be substantially clean. Preferably, the above described process is repeated with the rotating spray nozzle 58 being lowered through the other openings in the fuel tank 10 with the stinger 30 being moved as needed.

As previously stated, it is contemplated that the above described steps involving the spraying rig 36, the lateral sprayer 46, and the rotational sprayer 56 can be rearranged as desired or as necessitated by a particular cleaning application. For example, the order of the steps can be reversed, with the rotational sprayer 56 being used first, the lateral sprayer second 46, and the spraying rig last 36. Furthermore, it is contemplated that any of the above-described steps can be omitted. For example, if it is determined from the initial bacon bomb sample and from the initial vacuum removal of loose contaminants from the fuel tank 10 that the fuel tank 10 is relatively clean, the steps involving the spraying rig 36 and the lateral sprayer 46 can be omitted and only the rotational sprayer 56 can be used. Alternatively, if the particular fuel tank being cleaned only has a single opening that is adjacent one of its longitudinal ends, the lateral sprayer 46 and the rotational sprayer 56 can be omitted and only the spraying rig 36 can be used.

Figure 11:
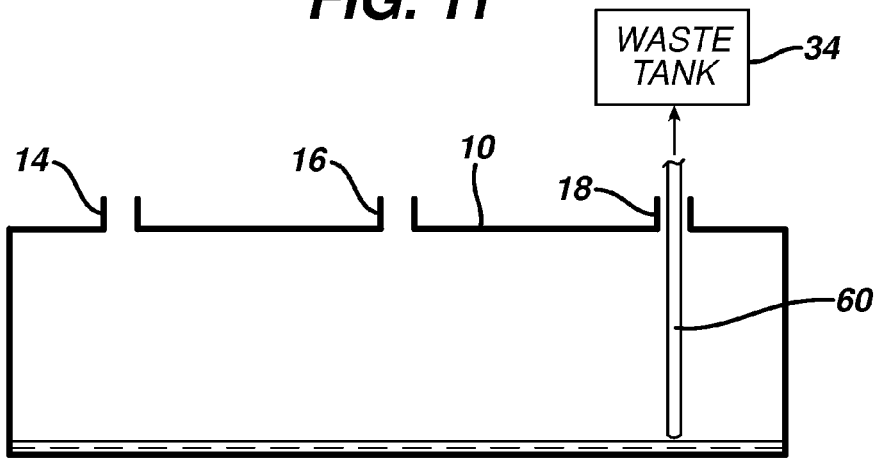
FIG. 11 is a side view in section illustrating the preferred embodiment of the seventh step of the present invention with the stinger being used to dry the fuel storage tank.

Referring now to FIG. 11, after it is determined that the fuel storage tank 10 has been sufficiently cleaned, a stinger 60 having a smaller diameter (and therefore greater suction force) than the stinger 30 described above is successively lowered through each of the fuel tank's openings 14-18 and is used to vacuum residual water out of the fuel tank 10 and into the waste tank 34. Although the smaller stinger 60 is preferred for drying the fuel tank 10, it is contemplated that the larger stinger 30, or any other suitable vacuuming means, can alternatively be used to dry the fuel tank 10.

Figure 12:
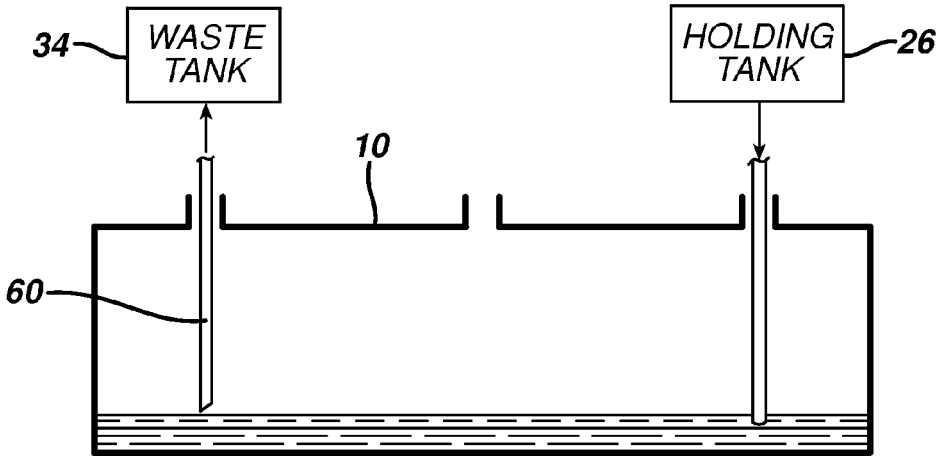
FIG. 12 is a side view in section illustrating the preferred embodiment of the eighth step of the present invention with residual water being flushed out of the fuel storage tank.
Figure 13:
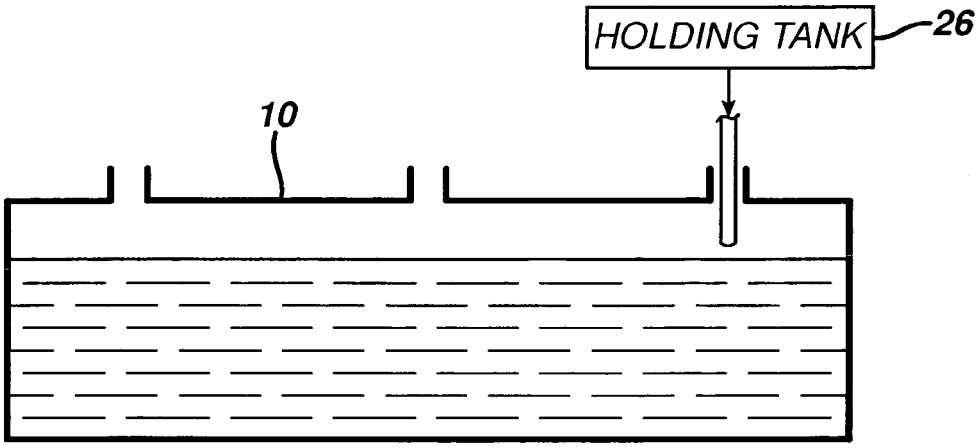
FIG. 13 is a side view in section illustrating the preferred embodiment of the ninth step of the present invention with clean fuel being pumped back into the fuel storage tank.

After the fuel tank 10 has been dried, about 20-50 gallons of clean fuel from the holding tank are added to the fuel storage tank to flush any remaining residual water from the bottom of the fuel tank 10, as illustrated in FIG. 12. This fuel is then vacuumed out of the fuel tank into the waste tank 26, preferably using the smaller stinger 60. The remaining clean fuel from the holding tank 26 is then pumped back into the fuel tank 10, as shown in FIG. 13. A final bacon bomb sample is taken from the fuel storage tank in the same manner as described above to ensure that the fuel tank 10 is clean. If the tank still contains an unacceptable level of contaminants, any or all of the steps described above can be repeated to further clean the fuel tank 10.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. The method for cleaning a fuel tank having an upper surface with at least one opening formed therein comprising:

a. lowering a vacuum stinger into said at least one opening and vacuuming loose contaminants out of the fuel tank and into an external waste tank;

b. lowering a rotating nozzle connected to a water supply line into the fuel tank through said at least one opening and suspending the nozzle at a position substantially intermediate an upper surface and a lower surface of the tank;

c. supplying pressurized water to the rotating nozzle through the water supply line to wash contaminants from interior surfaces of the tank;

d. lowering the vacuum stinger into said at least one opening and vacuuming the contaminants and wash water out of the fuel tank and into the external waste tank;

e. lowering a self-propelled nozzle connected to a water supply line into the fuel tank through said at least one opening and directing the self-propelled nozzle along the lower surface of the tank;

f. lowering the vacuum stinger into the fuel tank through said at least one opening;

g. supplying pressurized water to the self-propelled nozzle through the water supply line;

h. feeding more water supply line into the tank, thereby allowing the self-propelled nozzle to travel across the lower surface of the fuel tank away from the vacuum stinger while washing contaminants from the interior surfaces of the tank back toward the vacuum stinger; and i. pulling the water supply line out of the tank, thereby drawing the self-propelled nozzle back across the lower surface of the fuel tank toward the vacuum stinger while washing contaminants from the interior surfaces of the tank toward the vacuum stinger.

2. The method for cleaning a fuel tank in accordance with claim 1, further comprising measuring a level of contaminants present in the fuel tank before cleaning the tank for determining how thoroughly the tank should be cleaned.

3. The method for cleaning a fuel tank in accordance with claim 1, further comprising pumping fuel from an external storage tank into the fuel tank.

4. The method for cleaning a fuel tank in accordance with claim 3, further comprising, after pumping the fuel in the external storage tank into the fuel tank, measuring a level of contaminants present in the fuel tank for determining whether the fuel tank requires further cleaning.

5. A method for cleaning a fuel tank having an upper surface with at least one opening formed therein comprising:

a. lowering a vacuum stinger into said at least one opening and vacuuming loose contaminants out of the fuel tank and into an external waste tank;

b. lowering a self-propelled nozzle connected to a water supply line into the fuel tank through said at least one opening and directing the nozzle along the lower surface of the tank;

c. lowering a vacuum stinger into the fuel tank through said at least one opening;

d. supplying pressurized water to the self-propelled nozzle through the water supply line;

e. feeding more water supply line into the fuel tank, thereby allowing the self-propelled nozzle to travel across the lower surface of the fuel tank away from the vacuum stinger while washing contaminants from the interior surfaces of the tank back toward the vacuum stinger;

f. pulling the water supply line out of the fuel tank, thereby drawing the self-propelled nozzle back across the lower surface of the fuel tank toward the vacuum stinger while washing contaminants from the interior surfaces of the tank toward the vacuum stinger and vacuuming the contaminants and wash water out of the fuel tank and into an external waste tank;

g. lowering a rotating nozzle connected to a water supply line into the fuel tank through said at least one opening and suspending the nozzle at a position substantially intermediate an upper surface and a lower surface of the tank;

h. supplying pressurized water to the rotating nozzle through the water supply line to wash contaminants from interior surfaces of the tank;

i. lowering a lateral sprayer connected to a water supply line into the fuel tank through said at least one opening and directing an outlet of the lateral sprayer along the lower surface of the tank;

j. supplying pressurized water to the lateral sprayer through the water supply line to wash contaminants from lower interior surfaces of the tank; and k. lowering a vacuum stinger into said at least one opening and vacuuming the contaminants and wash water from the lower surface of the tank and collecting the contaminants and wash water in an external waste tank.

6. The method for cleaning a fuel tank in accordance with claim 5, further comprising measuring a level of contaminants present in the fuel tank before pumping the stored fuel out of the fuel tank for determining how thoroughly the fuel tank should be cleaned.

7. The method for cleaning a fuel tank in accordance with claim 5, further comprising pumping fuel from an external storage tank into the fuel tank.

8. The method for cleaning a fuel tank in accordance with claim 7, further comprising measuring a level of contaminants present in the fuel tank for determining whether the fuel tank requires further cleaning.

* * * * *